US005173172A

United States Patent [19]

Adams et al.

[11] Patent Number: 5,173,172

[45] Date of Patent: Dec. 22, 1992

[54] PRODUCTION OF HARD ASPHALTS BY ULTRAFILTRATION OF VACUUM RESIDUA

[75] Inventors: Brian B. Adams, Sarnia; John A. Thompson, Lady Smith, both of Canada

[73] Assignee: Exxon Research and Engineering Company, Florham Park, N.J.

[21] Appl. No.: 746,542

[22] Filed: Aug. 19, 1991

[51] Int. Cl.[5] ..... C10C 1/00

[52] U.S. Cl. ..... 208/39; 208/22; 208/44; 106/273.1

[58] Field of Search ..... 208/39, 44; 106/273.1

[56] References Cited

U.S. PATENT DOCUMENTS

| | | | |
|---|---|---|---|
| 4,411,790 | 10/1983 | Arod et al. | 210/637 |
| 4,797,200 | 1/1989 | Osterhuber | 208/308 |
| 4,816,140 | 3/1989 | Trambouze et al. | 208/309 |
| 4,874,523 | 10/1989 | LaFreniere | 208/308 |

FOREIGN PATENT DOCUMENTS 4013509 2/1979 Japan .

OTHER PUBLICATIONS

"Colloidal Nature of Petroleum" Witherspoon, Trans. N.Y. Acad. Sci. 24, Ser. 2, No. 4, 344–61 (1962).

"Hindered Diffusion of Asphaltenes Through Microporous Membranes" Baltus, et al, Chem. Eng. Sci. vol. 38, No. 12 pp. 1959–1969 (1983).

*Primary Examiner*—Helane Myers

*Attorney, Agent, or Firm*—Joseph J. Allocca

[57] ABSTRACT

Hard asphalts exhibiting acceptable penetration and low temperature properties can be produced from vacuum residua from which such hard asphalts are not normally obtainable via typical vacuum distillate such as that derived from Arab Light crude and/or feeds substantially comprising Arab Light-type crudes by ultrafiltering the residua through a membrane.

6 Claims, No Drawings

PRODUCTION OF HARD ASPHALTS BY ULTRAFILTRATION OF VACUUM RESIDUA

BRIEF DESCRIPTION OF THE INVENTION

Hard asphalts exhibiting a penetration of less than 100 and commensurate low temperature properties, preferably the properties of an 85/100 asphalt, can be made from vacuum residua which ordinarily cannot be used to produce such asphalt under normal vacuum tower operating conditions, preferably vacuum residua derived from Arab light or similar crude or feeds substantially comprising Arab light crude or similar crudes by ultrafiltering the vacuum residua through a membrane. The permeate obtained, of substantially reduced metals content, is useful as cat feed. The retentate is harder than the pitch fraction produced under normal vacuum tower operating conditions. In refineries which are not equipped with sophisticated vacuum distillation equipment, oxidizers, or propane deasphalters, it would not be possible to produce acceptable hard asphalts from such vacuum residua by typical refinery distillation.

Thus, ultrafiltration of this vacuum residua preferably Arab Light-type vacuum residua permits the production of acceptable hard asphalt directly without resort to sophisticated vacuum distillation procedures, oxidizers, or propane deasphalters. A collateral benefit is an increased production of reduced metals content cat feed as permeate.

BACKGROUND OF THE INVENTION

Treating hydrocarbon charges by ultrafiltration is a process known in the art.

Japanese 4013509 describes the purification of oils such as lubricating oil or naphtha by filtering the oil through an ultrafiltration membrane made from polymers such as acrylonitrile styrene copolymer or polysulfone polymer. The oils treated can be lube oil, naphtha (e.g., residual oil from vacuum distillation), spent lube oil, or carbon-containing spent wash oil for engines. The process involves filtering the oil through an ultrafiltration membrane at a pressure of 1–20 kg/cm$^2$, a flow rate of 2–4 m/sec and a temperature of 5.50° C.

U.S. Pat. No. 4,411,790 describes the use of inorganic membranes for high temperature ultrafiltration of oils. The process can be used to regenerate used lube oil or to reduce the asphaltene content of heavy oils such as vacuum residua. The membrane is an inorganic ultrafiltration barrier having a pore radius of 50–250Å coated with a metal oxide layer. The process is run at temperature above about 100° C. Membrane plugging is prevented by periodically applying back pressure.

U.S. Pat. No. 4,797,200 describes separating heavy oil by diluting the oil with a solvent such as chloroform or toluene and ultrafiltering the diluted oil through an ultrafiltration membrane such as cellulose or polyvinylidene fluoride at about 750–1500 kPa and 20°–125° C. A permeate of reduced conradson carbon content and reduced vanadium and nickel content is recovered. The retentate can be fed to a deasphalting process. The permeate of reduced metal and conradson carbon residue content has the characteristics of gas oil and may be used as cat cracker feed with or without further hydrotreatment. The process can be run on raw or reduced crudes, heavy atmospheric and heavy vacuum residual oils, hydrorefined oils and hydrorefined atmospheric residual oils, shale oil, tar sands products, and coal liquefaction products.

U.S. Pat. No. 4,816,140 combines conventional deasphalting with membrane ultrafiltration. The solvent used to perform a conventional solvent deasphalting step is recovered from the deasphalted oil as filtrate by ultrafiltration through inorganic membrane.

THE PRESENT INVENTION

It has been discovered that asphalts having a penetration of less than 100@25° C. and commensurate low temperature properties preferably the penetration and low temperature characteristic of an 85/100 asphalt cement can be made from vacuum residua which ordinarily cannot be used to produce such asphalt under normal vacuum tower operating conditions, preferably vacuum residua derived from Arab light or similar crudes or feeds substantially comprising Arab light or Arab light type crudes by ultrafiltering the vacuum residua through a membrane. As used hereafter in the specification and the appended claims the crude source of such vacuum residua which ordinarily cannot be used to produce such asphalts under normal vacuum tower operating conditions is characterized as being and described as a crude whose vacuum residua is an inappropriate hard asphalt source while such vacuum residua is designated an inappropriate residua. Acceptable asphalts of less than 100 penetration could not be made from such inappropriate residua by simple vacuum distillation directly but required the use of sophisticated vacuum distillation procedures, oxidizers, or propane deasphalters. The present invention offers an alternative to using oxidizers and propane deasphalting to produce acceptable asphalt from such crudes whose vacuum residua is an inappropriate hard asphalt source, preferably Arab light-type crude source vacuum residua.

Arab Light crude cannot be vacuum reduced under normal refinery conditions to 85/100 penetration, a common hard grade of paving asphalt in Canada and the United States. This is a function of crude composition. Arab Light 120/150 penetration vacuum residua has the following typical composition

| | |
|---|---|
| Asphaltenes (NHI) | 8 wt % |
| Saturates | 11 wt % |
| naphthene-aromatics | 52 wt % |
| polar aromatics | 29 wt % |

Asphaltenes give hardness to asphalt. Saturates can also contribute to this property if wax is present. Arab Light crude produces vacuum reduced asphalts which have satisfactory high-temperature viscosity; however, their low temperature properties are mediocre because of the presence of wax. Pavements made with such asphalts can crack under severe winter conditions (i.e., low temperature). Ultrafiltration done on Arab Light residue indicates that the viscosity-penetration relationship for the retentate has not been affected. There is some evidence that its low temperature properties may be improved.

Other crudes having similar quantities of asphaltenes, saturates and aromatics of the same type as Arab Light (See Table 2) may behave similarly when processed to make asphalt, that is, they will not be able to be distilled to make the harder grades.

Arab light or Arab light type crudes (including crudes such as Isthmus and Basrah) can be characterized in the following way (see Table 1):

TABLE 1

CANDIDATE CRUDES FOR ULTRAFILTRATION

| | Crude | | | | |
|---|---|---|---|---|---|
| Vacuum Residue | Arab Lt. | Isthmus | Tia Juana Lt. | 50% T.J. Lt. - 50% Isthmus | Basrah |
| Fraction, °C. | 566+ | 565+ | 560+ | 565+ | 565+ |
| Yield, vol % | 15.9 | 13.2 | 14.4 | 15.8 | 16.9 |
| Penetration, @25° C. | 175 | 257 | 106 | 153 | 140 |
| Viscosity, @135° C. | 246 | 159 | 310 | 224 | 268 |
| Penetration Index | −1.8 | −2.65 | −1.1 | −2.2 | −2.3 |
| Penetration Ratio | 25.0 | 20.0 | 31.1 | 23.5 | 23.8 |
| Pen-Vis No. | −0.32 | −0.59 | −0.55 | −0.64 | −0.46 |

Vacuum residua obtained from these types of crudes cannot be simply distilled to produce useful, hard asphalts having penetration of less than 100, preferably 85/100 penetration grade asphalt cements. Such residua could not be vacuum reduced to 100 penetration or lower without carbonizing and degrading the pitch product. To produce useful asphalts from such inappropriate residua it has been necessary to resort to using oxidizers or propane deasphalters. Such units or processes are not available at all refineries and, therefore, limited the refineries, ability to make quality asphalt when such inappropriate crudes.

Paving asphalt cements, or basestocks for roofing and industrial asphalts, have traditionally been manufactured by the distillation of certain selected crude oils. Crude oils that are unsuitable for asphalt products are mainly those with high wax contents. Their composition can give vacuum residues which have low viscosity at 135° C. relative to their penetration and/or poor low temperature properties as measured by their penetration indices and penetration ratios.

Arab light crude (a readily available feedstock) and Arab light-type crudes having moderately high wax contents give vacuum residues which have satisfactory viscosity vs penetration but have poor low temperature properties.

These crudes cannot be vacuum reduced under normal plant vacuum tower conditions to much less than 100 penetration at 25° C. A penetration of 100 or greater is softer than that required by road builders in many parts of the world.

Table 2 gives the composition, by Corbett Analysis, of three vacuum resides considered waxy; one from Arab light and two from Arab light-type crudes. These residues have the same penetration at 25° C. Those made from Cano Limon and Redwater-Gulf crudes have poor viscosity vs penetration as well as poor low temperature properties, would be unacceptable for use as paving asphalt cement by most road builders, and cannot be used to make good hard asphalt having a penetration of less than 100, preferably an asphalt meeting the 85/100 specification.

TABLE 2

TYPICAL PHYSICAL INSPECTIONS FOR THREE CRUDE SOURCES

| Samples Crude | Cano Limon | Arab Lt. | Redwater Gulf |
|---|---|---|---|
| Fraction, °C. | 453+ | 562+ | 515+ |
| Penetration at 25° C. (100/5) | 335 | 304 | 354 |
| Viscosity at 135° C., cST | 85.5 | 171.4 | 87.4 |
| Composition, wt % | | | |
| Asphaltenes | 12.66 | 8.03 | 6.49 |
| Saturates | 24.84 | 11.09 | 19.30 |
| Naphthene-Aromatics | 32.73 | 52.15 | 39.94 |
| Polar Aromatics | 29.36 | 28.60 | 33.90 |
| Sats + Naphthene Collection | | | |
| Asphaltenes, wt % | 13.20 | 8.92 | 7.41 |
| | 13.08 | 8.03 | 7.21 |
| | | 8.38 | 7.42 |
| | | 8.80 | 6.70 |
| | | 8.59 | 6.71 |
| | | 8.79 | 6.23 |
| | | 8.82 | |

DESIRABLE CRITICAL PROPERTIES FOR ASPHALT EASTERN CANADA 85/100 PENETRATION GRADE

| | |
|---|---|
| Penetration at 25° C., mm/10 | 85–100 |
| Viscosity at 135° C., cSt | 280–and higher |
| Flash Point, COC. °C. | 230 minimum |
| Ductility @4° C. (1 cm/min) | 6 min. |
| 25° C. (5 cm/min) | 100 min. |
| Solubility in TCE, m % | 99.5 min. |
| Thin Film Oven Test: | |
| Change in Mass, % | 0.85% max. |
| Retained Penetration, % | 47 |
| Ductility of Residue @25° C. | 75 min. |
| Penetration Index (*) | −1.6–and higher |

(*) Not a government specification, but an internal guideline based on climatic conditions and competitive asphalt quality.

residua that are otherwise and in other ways totally unacceptable for asphalt production. Ultrafiltration permits production of acceptable asphalt from vacuum residua without resort to sophisticated vacuum distillation systems, high vacuum distillation systems, oxidizers, or propane deasphalters. In the case of poor totally unacceptable crudes for which resort to even these sophisticated systems cannot produce good asphalt, ultrafiltration will also be incapable of producing good asphalt. Thus, vacuum residua possessing totally unacceptable viscosity properties cannot be ultrafiltered into good asphalt because, while ultrafiltration may improve penetration index and penetration ratio, ultrafiltration will not improve the penetration-viscosity relationship (pen-vis no).

Thus, inappropriate vacuum residua, preferably Arab Light or Arab Light-type crude vacuum residua which are candidates for ultrafiltering to produce hard asphalts would be characterized as possessing a penetration at 25° C. (100/5) of about 120 and greater, and a viscosity at 135° C. (in cSt) of about 310 and less.

Table 3 gives the typical physical properties of Arab Light asphalts made by vacuum distillation and shows their penetration indices (−1.8) and penetration ratios (25.0) to be much lower than acceptable in Canada. Also, it is not possible to make the 85/100 grade. The removal of wax from Arab Light minimum residue (562° C.+, Table 1) could give harder residues having improved low temperature properties. However, resort to solvent dewaxing or catalytic dewaxing of vacuum residue is not an attractive alternative, nor something routinely carried out on crudes prior to, or in the course of, atmospheric/vacuum distillation.

TABLE 3

ASPHALT ASSAY
Crude: Arabian Light
PAVING ASPHALT CEMENTS
Target Specifications

| Penetration Grade | 85/100 | 150/200 | 200/300 | 300/400 |
|---|---|---|---|---|
| Fraction °C. | | 566+ | 557+ | 542+ |
| Yield on Crude, vol % | (Extrapolated) | 15.9 | 17.0 | 17.9 |
| Properties | | | | |
| Penetration at 25° C. (100/5) | 90 | 175 | 250 | 350 |
| Penetration Index | −1.8 | −1.80 | −1.82 | −1.82 |
| Penetration Ratio (1) | 25.5 | 25.0 | 24.8 | 24.5 |
| Viscosity at 60° C., Poise | 1575 | 640 | 415 | 285 |
| 100° C., cSt | 3100 | 1740 | 1280 | 960 |
| 135° C., cSt | 360 | 246 | 202 | 167 |
| Ductility at 4° C. (1 cm/min), cm | | >50 | >50 | >50 |
| 25° C. (5 cm/min), cm | | >150 | 125 | 55 |
| Softening Point (D36), °C. | | 37.0 | 34.1 | 30.8 |
| Density at 15° C., kg/ms$^3$ | | 1024.5 | 1021.0 | 1017.8 |
| Acid No., mg KOH/g | | <0.1 | <0.1 | <0.1 |
| Flash Point (COC), °C. | | 362 | 357 | 351 |
| Thin Film Oven Test | | | | |
| Change in mass, % | | +0.10 | +0.11 | +0.11 |
| Residue: | | | | |
| Retained Penetration at 25° C., % | | 68.4 | 66.0 | 64.0 |
| Viscosity Ratio at 60° C. | | 1.60 | 1.59 | 1.50 |
| Ductility at 25° C. (5 cm/min), cm | | >150 | >150 | >150 |

(1) 100 [4° C. (200/60) 25° C. (100/5)].

Ultrafiltration of both Arab light and Arab light-type crude vacuum residua has been found to produce retentates which possess acceptable asphalt properties.

Ultrafiltration can be carried out using membranes having a pore size from about 0.01 micron to 1.0 micron, preferably about 0.1 micron.

Useful membranes include both polymeric and ceramic membranes such as polyimide, polysulfone, nylon, polyester imide or other high temperature stable polymeric membranes, alumina or other refractory metal oxide, sintered metal, or glass non-polymeric membranes. A preferred polyimide membrane is the polyimide ultrafiltration membrane disclosed and claimed in U.S. Pat. No. 4,963,303.

Ultrafiltration can be carried out at pressure differentials across the membrane ranging from about 30–400 psi, preferably about 30–100 psi and temperatures sufficiently high to keep the vacuum residue liquid. Typical temperatures will range from 150°–200° C. for high temperature stable polymeric membranes while much higher temperatures can be used for the ceramic, sintered metal or glass membranes.

If lower operating temperatures are desired, a diluent can be added to the vacuum residue. It is desirable to use just enough diluent to help keep the vacuum residue in the liquid state at lower temperatures. Diluents such as kerosene, aliphatic solvents (e.g., Varsol Exsol D60, etc.) diesel or other light liquid hydrocarbon solvents can be used.

The selection of a solvent to be used to reduce the viscosity of vacuum residue is mostly going to depend on refinery economics. From an economic standpoint 0% dilution is most desirable as this would eliminate the necessity of solvent stripping the product in order to meet product specifications. From a unit operation standpoint the higher the dilution the better. For instance, work has been done using light vacuum gas oil (LVGO) at about the 20% level in blends with vacuum pipestill (VP) pitch. The LVGO normally goes to cat feed; in the ultrafiltration process, much of the LVGO would become a part of the permeate which would also go to cat feed. Similarly, other refinery light streams could be used (e.g., HVGO or HAGO). When dilution solvents are employed it is necessary to strip the recovered retentate to remove any residual solvent in order to produce an asphalt of the required specification hardness.

Although aromatic solvents may have better solvency for vacuum residue, paraffinic solvents can give greater rejection (of metals, MCR). Here again, refinery economics will determine what stream may be used. A stream such as splitter-bottoms may have desirable properties based on its paraffinic nature.

The retentate from the ultrafiltration contains a large amount of the metals present in the vacuum residua feed. This retentate constitutes the hard asphalt product.

The permeate, of reduced metals content is useful as cat feed.

Depending on the crude source, ultrafiltration conducted so as to secure a yield of about at least 75% retentate, preferably about 70% retentate, more preferably about 60% retentate, most preferably about 35–40% retentate, based on feed. At the lower yield percentages it may be necessary to employ one of the previously mentioned diluents in order to insure continued fluidity of the feed at a manageable temperature.

EXAMPLES

A refinery sample of vacuum residue (90% Arab Light crude feed) having a penetration at 25° C. of 341 mm/10 was ultrafiltered in a laboratory batch unit. Three runs were conducted on the vacuum residue as such. A fourth run was conducted using the vacuum residue diluted with Varsol, level of dilution, 17 vol%.

The retentate and permeate were stripped to remove the Varsol.

The ultrafiltration was performed using an Alcoa ceramic membrane having a pore size of 1000Å (0.1 micron) (Alcoa 1000Å ceramic alumina membrane). The membrane was in tubular form 7 mm ID×720 mm long. Temperature was maintained at 170° F.; flow rate was maintained at 6 gpm; inlet pressure was 120 psi/outlet pressure 80 psi.

The properties of the vacuum residua and the resulting retentate are presented in Table 4.

TABLE 4

| | | PROPERTIES OF RESIDUE AND RETENTATE | | | | | | | | |
|---|---|---|---|---|---|---|---|---|---|---|
| | | Feedstock | Vacuum Residue | Retentate, % of Feed | | | | | | |
| | | 413° C. COT | Hivac 569° C.+ | 81.7 | 71.7 | 62.3 | 37.5 | ARAB LIGHT ESSAY | | |
| | | (1) | (2) | (3) | (3) | (3) | (4) | 545° C.+ | 558° C.+ | 570° |
| Pen at | 25° C. (100/5) | 341 | 220 | 245 | 206 | 168 | 38.2 | 329 | 242 | 124 |
| | 10° C. (100/5) | 54.5 | 32.3 | 39.7 | 33.1 | 27 | 11 | 54 | 39 | 20.5 |
| | 4° C. (100/5) | 20.4 | 15.2 | 16 | 15.3 | 13.5 | 5.7 | 22 | 16 | 8.5 |
| | 4° C. (200/60) | 78.5 | 48.1 | 58.3 | 54.5 | 42.5 | 17.3 | 81 | 60 | 31 |
| Penetration Index | | −2.00 | −2.05 | −1.90 | −1.81 | −1.74 | −0.48 | −1.85 | −1.93 | −1.8 |
| Penetration Ratio | | 23.0 | 21.8 | 23.8 | 26.4 | 25.3 | 45.3 | 24.5 | 24.9 | 25.2 |
| Pen-Vis No. | | −0.23 | −0.35 | −0.35 | −0.39 | −0.48 | −0.49 | −0.09 | −0.15 | −0.4 |
| Viscosity, | 60° C., Ps. | 233 | 404 | 348 | 428 | 554 | 6748 | 297 | 465 | 1009 |
| | 100° C., cSt | 867 | 1269 | 1136 | 1256 | 1524 | 6793 | 1042 | 1331 | 2363 |
| | 135° C., cSt | 155 | 203 | 187 | 208 | 231 | 682 | 171 | 211 | 301 |

(1) Vacuum residue (1030° F. AET) from 90% Arab Light crude.
(2) Hivac distillation, 92.2 LV % of residue.
(3) Retentate from laboratory ultrafiltration unit.
(4) Feed diluted with Varsol; permeate and retentate then stripped.

What is claimed is:

1. A method for producing hard asphalts having a penetration of less than 100 at 25° C. and commensurate penetration-viscosity relationship (pen-vis no.) from inappropriate vacuum residua by ultrafiltering said vacuum residua through an ultrafiltration membrane wherein said inappropriate vacuum residua is characterized as one which cannot be used to produce the desired asphalt by vacuum distillation, thereby producing a retentate comprising the desired hard asphalt.

2. The method of claim 1 wherein the vacuum residua is derived from Arab Light or Arab Light-type crude, and prior to ultrafiltration, has a penetration, at 25° C. of about 120 and higher and a viscosity at 135° C. of about 310 and less.

3. The method of claim 2 wherein the hard asphalt recovered as retentate from the ultrafiltration of the Arab light or Arab light-type vacuum residua has a penetration at 25° C., in mm/10 of less than 100, a viscosity at 135° C. in cSt of 280 and higher and a penetration index of −1.6 and higher (more positive).

4. The method of claim 1 wherein the vacuum residue is mixed with a diluent prior to ultrafiltration.

5. The method of claim 1, 2, 3 or 4 wherein the ultrafiltration is carried out at a pressure differential across the membrane ranging from about 30 to 400 psi.

6. The method of claim 5 wherein the ultrafiltering membrane is selected from polymeric and ceramic membranes and has a pore size in the range of about 0.01 to 1.0 micron.

* * * * *